US005980024A

United States Patent [19]

Mitani et al.

[11] Patent Number: 5,980,024

[45] Date of Patent: Nov. 9, 1999

[54] INK JET PRINT HEAD AND A METHOD OF DRIVING INK THEREFROM

[75] Inventors: Masao Mitani; Kenji Yamada; Katsunori Kawasumi; Osamu Machida; Kazuo Shimizu, all of Hitachinaka, Japan

[73] Assignee: Hitachi Koki Co, Ltd., Tokyo, Japan

[21] Appl. No.: 08/740,895

[22] Filed: Nov. 4, 1996

Related U.S. Application Data

[63] Continuation-in-part of application No. 08/331,742, Oct. 31, 1994, Pat. No. 5,729,260.

[30] Foreign Application Priority Data

Oct. 29, 1993 [JP] Japan ..... 5-272451
Nov. 2, 1995 [JP] Japan ..... 7-285650

[51] Int. Cl.[6] ..... B41J 2/05

[52] U.S. Cl. ..... 347/57

[58] Field of Search ..... 347/9, 10, 14, 347/57, 56–58, 61, 62, 64, 92, 204

[56] References Cited

U.S. PATENT DOCUMENTS

| | | | |
|---|---|---|---|
| 4,313,124 | 1/1982 | Hara . | |
| 4,517,444 | 5/1985 | Kawahito et al. . | |
| 4,646,105 | 2/1987 | Matsumoto et al. . | |
| 5,036,897 | 8/1991 | Tamura et al. | 219/216 |
| 5,214,450 | 5/1993 | Shimoda . | |
| 5,479,196 | 12/1995 | Inada . | |

FOREIGN PATENT DOCUMENTS

| | | |
|---|---|---|
| 4317944A1 | of 0000 | Germany . |
| 3012720A1 | 10/1980 | Germany . |
| 3018852A1 | 11/1980 | Germany . |
| 3224061A1 | 1/1983 | Germany . |
| 3618533A1 | 12/1986 | Germany . |
| 4141203A1 | 6/1992 | Germany . |
| 48-9622 | 2/1973 | Japan . |
| 54-51837 | 4/1979 | Japan . |
| 54-59936 | 5/1979 | Japan . |
| 55-27281 | 2/1980 | Japan . |
| 55-27282 | 2/1980 | Japan . |
| 55-132267 | 10/1980 | Japan . |
| 55-161662 | 12/1980 | Japan . |
| 55-161663 | 12/1980 | Japan . |
| 55-161664 | 12/1980 | Japan . |

(List continued on next page.)

OTHER PUBLICATIONS

Hewlett–Packard Journal, Thermodynamics and Hydrodynamics of Thermal Ink Jets, Allen et al., vol. 36, No. 5, May 1985. pp. 21–27.
Partial Translation of Iida et al.

(List continued on next page.)

*Primary Examiner*—John Barlow
*Assistant Examiner*—L. Anderson
*Attorney, Agent, or Firm*—Whitham, Curtis & Whitham

[57] ABSTRACT

In an ink ejection type recording device in which expansion of bubble ejects an ink droplet from a nozzle toward a recording medium, a heater formed in an ink channel is applied with a pulse of voltage by a driver circuit. The pulse of voltage is determined so that the surface of the heater in direct contact with the water-based ink is rapidly heated to a temperature causing to invoke caviar-wise nucleation of the ink that is in direct contact with the surface of the heater. Expanding bubbles resulting from the caviar-wise nucleation ejects an ink droplet from the nozzle, wherein the heater is heated at a heating speed in a range from $1\times10^{8\circ}$ C./sec to $5\times10^{8}$ °C./sec, and the surface of the heater is heated up from a room temperature to a temperature substantially equal to 320 C within a period of time ranging from 0.6 to 3 $\mu$sec. By heating the heater under these conditions, the ink in contact with the heater starts boiling with a high boiling pressure, the generated bubble has a large volume, and thus the bubble can generate pressure sufficiently large to eject the ink droplet.

10 Claims, 6 Drawing Sheets

FOREIGN PATENT DOCUMENTS

| | | |
|---|---|---|
| 55-161665 | 12/1980 | Japan . |
| 56-13177 | 2/1981 | Japan . |
| 56-27354 | 3/1981 | Japan . |
| 57-61582 | 4/1982 | Japan . |
| 58-84401 | 5/1983 | Japan . |
| 246389 | 10/1990 | Japan . |
| 3266646 | 11/1991 | Japan . |

OTHER PUBLICATIONS

Nikkei Mechanical, Dec. 28, 1992, pp. 58–63.

J.P. Baker et al.; "Design and Development of a Color Thermal Inkjet Print Cartridge"; Hewlett–Packard Journal, Aug. 1988, pp. 6–15.

Collection of Presentations from the Journal for the 22nd Japan Thermal Transmission Symposium 1985–5, pp. 7–9.

Collection of Presentations from the Journal for the 23rd Japan Thermal Transmission Symposium 1986–5, pp. 247–249.

Collection of Presentations from the Journal for the 25th Japan Thermal Transmission Symposium 1988–6, pp. 253–255.

Collection or Presentations from the Journal for the 27th Japan Thermal Transmission Symposium 1990–5, pp. 334–336.

Collection of Presentations from the Journal for the 28th Japan Thermal Transmission Symposium 1991–5, pp. 712–714.

Presentation Papers published from Japan Mechanical Society, vol. B60, No. 572 (1994–4), pp. 264–270.

N. Elsner, "Convective Heat Transfer when Changing the Aggregate State" (1980), pp. 515–525.

INK JET PRINT HEAD AND A METHOD OF DRIVING INK THEREFROM

CROSS-REFERENCE TO A RELATED APPLICATION

This application is a Continuation-In-Part application of application Ser. No. 08/331,742 filed Oct. 31, 1994, now issued as U.S. Pat. No. 5,729,260.

BACKGROUND OF THE INVENTION

1. Field of the Invention

The present invention relates to an ink jet recording device that uses heat energy for ejecting ink droplets toward a recording medium. The invention further relates to a method of driving the ink jet recording device.

2. Description of the Related Art

Japanese Laid-Open Patent Publication Nos. SHO-48-9622, SHO-54-51837, SHO-54-59936, SHO-54-161935 describe a type of ink jet recording device with channels filled with ink and nozzles, each in fluid communication with an ink channel. A pulse of heat is applied to the ink, which rapidly vaporizes as a result. The expansion of the resultant vapor bubble ejects a droplet of ink from the corresponding nozzle.

The most effective method of producing the heat pulse is with a thin film thermal resistor provided in the ink channel. Practical examples of thin film thermal resistors are described at page 58 of the "Nikkei Mechanical", published Dec. 28, 1992 and the "Hewlett-Packard Journal" published August 1988. These thermal resistor commonly include a thin film resistors with great thermal endurance, a metal thin film conductor, and a two-layer protective covering over the thin film resistor and the metal thin film conductor. The thin film forming the thin film resistors is about 0.1 $\mu$ thick. The two-layer structure of the protective covering is about 3 to 4 $\mu$ thick in total. The first layer of the protective covering is in contact with the thin film resistor and the metal thin film conductor and is for protection against oxidation and electrochemical corrosion. The second protective layer is provided for protecting the first protective layer against damage from cavitation.

Thermal resistors constructed as described above are used to pulse heat and rapidly vaporize the portion of the ink adjacent to the thermal resistor. Ink droplets are ejected by expansion of the resultant bubble. Printers must be able to rapidly repeat the ejection process which includes not only expansion of bubbles, but also the contraction and final disappearance of bubbles. Four conditions are required to produce a printer that can eject ink droplets stably and rapidly in succession at a high frequency.

The first condition relates to the generation of bubbles. Japanese Laid-Open Patent Publication Nos. SHO-55-27282 and SHO-56-27354 teach that in order to increase ejection efficiency, response, and frequency characteristics, the temperature at the surface of the thermal resistor must be rapidly increased to thereby invoke film boiling in the ink in contact with the thermal resistor, and the processes A through E shown in FIG. 1, which show the boiling characteristic curve of water, should be kept as short as possible. However, there are two points in the technical explanation and understanding in these publications which need correction.

The first point to be corrected is that the boiling characteristic curve shown in FIG. 1 represents a set stable state whereas ejection of ink droplets occurs in an unstable state. In the boiling characteristic curve shown in FIG. 1, the temperature at the heater surface that contacts the water is stable or rises and lowers slowly. Boiling which occurs from application of a pulse of heat is unsteady boiling. In fact, in subsequent research (see page 7 of Collection of Presentations from the 22nd Japan Thermal Transmission Symposium 1985-5), the inventors of the above-listed applications disclose that test bubbles were generated at 263° C. This temperature matches the superheating limit of 270° C. predicted by the theory of spontaneous nucleation. That is, bubbles are generated by unstable boiling, which is a very different phenomenon from the phenomenon of stable boiling represented in FIG. 1.

The second point to be corrected is the inappropriate use of the term film boiling. Film boiling assumes that conditions continue for a certain length of time. However, an extremely short pulse of heat rapidly generates a single bubble that vanishes in an extremely short period of time. In later research (see page 7 of the Collection of Presentations from the 22nd Japan Thermal Transmission Symposium 1985-5, on page 247 of the Collection of Presentations from the Journal for the 23rd Japan Thermal Transmission Symposium 1986-5, and on page 253 of the Collection of Presentations from the Journal for the 25th Japan Thermal Transmission Symposium 1988-6), the inventors of the above-listed applications changed their opinions to say that a small bubble is formed from spontaneous nucleation (also referred to as heterogenous nucleation) at a portion of the heater surface and afterward rapidly expands to the entire surface of the heater.

Therefore, it is technically incorrect to say that in order to increase ejection efficiency, response, and frequency characteristics, the temperature at the surface of the thermal resistor must be rapidly increased to thereby invoke film boiling in the ink in contact with the thermal resistor, and the processes A through E shown in FIG. 1, which shows the boiling characteristic curve of water, should be kept as short as possible. Taking the two points into consideration, a more accurate statement would be that the ink in contact with the surface of the heater should be brought into a film boiling condition in as short a time as possible.

Japanese Laid-Open Patent Publication No. HEI-03-266646 describes a thermal ink jet print head which uses a boiling phenomenon appearing when ink is heated under conditions different from those in the above-described research. The surface of the heater is raised at a speed of $10^6$ to $10^{9}$° C./S and the heat flux from the heater surface to the ink is set at $10^7$ to $10^8$ W/m$^2$. The temperature at the heater surface and the ink adjacent to the heater surface is rapidly heated to the temperature at which homogeneous nucleation occurs. Ink is ejected by a homogeneous nucleated bubble.

The type of boiling that is ordinarily observed occurs by vapor nucleation. For example, vapor nucleation occurs at defects in the solid surface in contact with water when the temperature of the water reaches about 100° C.

Spontaneous nucleation occurs when no defects are present in the solid surface in contact with the liquid to be boiled, that is, when the solid surface is perfectly uniform. Boiling activated by spontaneous nucleation occurs simultaneously over the entire boundary between the solid surface and the liquid. When the liquid to be boiled is water, boiling will start only when the temperature at the solid surface reaches about 270° C. Spontaneous nucleation is also referred to as non-homogeneous nucleation because thus activated boiling occurs where solid and liquid coexist.

Homogeneous nucleation occurs only in superheated homogeneous liquids in contact with a uniform solid surface, as described above for spontaneous nucleation, that is rapidly heated. Refer to V. P Skripove, Metastable Liquids, John Wiley, New York 1974. The temperature at which homogeneous nucleation is assumed to occur in water is 312.5° C. However, it is technically difficult to produce a heater which can generate the extremely rapid increase in temperature necessary for homogeneous nucleation to occur. In fact, there has been no confirmation of an actual heater with this capability.

Homogeneous nucleation is termed homogeneous, despite the presence of a solid surface, because homogeneous nucleation can be observed only in homogeneous liquids. Boiling begins in water adjacent to the boundary between the liquid and the solid surface when critical values for both the speed at which the solid surface rises and the heat flux that is transmitted to the liquid from the solid surface are exceeded and when the temperature at the solid surface and the water adjacent to the solid surface exceeds 312.5° C.

Recently, Iida et al experimentally verified this phenomenon as discussed on page 334 of Collection of Presentations from the 27th Japan Thermal Transmission Symposium 1990-5. The invention described in Japanese Laid-Open Patent Publication No. HEI-03-266646 is based on the results of these experiments, in which the thermal resistor and the electrode are formed from the same material. However, the width of the electrode is at least five times and up to ten times the width of the thermal resister. This makes manufacturing an inexpensive large-scale line head difficult, although a head with a low density of 30 dpi could possibly be produced. That is, using this thermal resistor in a high density multi-nozzle type ink jet print head would be impossible without adding some further contrivance.

The second condition relates to the speed at which the thermal resistor is heated. Japanese Laid-Open Patent Publication No. SHO-55-161664 teaches that the average speed at which temperature of the thermal resistor increases (hereinafter referred to as "average speed of temperature increase") should be $1\times10^{6}$° C./sec or more, preferably $3\times10^{6}$° C./sec or more, and optimally $1\times10^{7}$° C./sec or more. The liquid described in the publication is ink made mainly from ethanol. Recently, Iida et al performed precise experiments using pure ethanol. The average speed of temperature increase and the number of bubbles generated during these experiments are described in detail on page 712 of Collection of Presentations from the 28th Japan Thermal Transmission Symposium 1991-5. Although some discrepancies in the data can be accounted for by differences between pure ethanol and ink made mostly from ethanol, the most noteworthy result is that bubbles were generated at a density, which most closely governs ejection of ink, that was two orders of magnitude greater in ethanol than in water at the same average speed of temperature increase. That is, in order to generate the same number of bubbles in the same density, water must be heated at an average speed of temperature increase that is ten times faster than the average speed of temperature increase required for ethanol.

Therefore, a great technological leap is required to apply the invention described in Japanese Laid-Open Patent Publication No. SHO-55-161664 to water-based ink. An extremely fast average speed of temperature increase of about $1\times10^{8}$ °C./sec or more is required to stably eject water-based ink.

The average speed of temperature increase of $3\times10^{7}$° C./sec could attained as reported on page 247 of the 23rd Japan Thermal Transmission Symposium Collection of Presentations 1986-6, and 7 to $8\times10^{7}$° C./sec on the 25th Japan Thermal Transmission Symposium Collection of Presentations 1988-6. Further, the ink jet printers normally operate with 5 μsec of heating pulse width. The thin film thermal resistor needs to be heated up to about 300° C., so that the average speed of temperature increase in the ink jet printers is $300/(5\times10^{-6})=6\times10^{7}$° C./sec. Because the thin film thermal resistor used therein is covered with a protective layer of about 4 μm on its surface, the speed of temperature increase on the surface of the thermal resistor contacting the ink would be slightly slower than the speed as calculated above.

When the average speed of temperature increase is further increased, it is confirmed that caviar-wise nucleation occurs in pure water as is theoretically predicted (See the 27th Japan Thermal Transmission Symposium Collection of Presentations 1990-5, page 334 and Presentation Papers published from Japan Mechanical Society, vol. B60, No. 572 (1994-4), page 264. In these reports, experiments were performed using a heater with no protection layer and the average speed of temperature increase of $9.3\times10^{7}$° C./sec was attained.

Japanese Laid-Open Patent Publication No. HEI-3-266646 discloses that good ink ejections are performed when the average speed of temperature increase is in a range from $10^{6}$ to $10^{9}$° C./sec or more.

The third condition relates to the time between when the heat pulse starts and when the liquid starts to boil (hereinafter referred to as "the time to boiling start"). Asai et al discloses use of a naked heater without protective layers (page 7 of the Collection of Presentations from the 22nd Japan Thermal Transmission Symposium 1985-5). Although the lack of protective layers improves the rate of heat transmission, it also reduces reliability. Asai et al described tests using ethanol. Bubbles can be generated in ethanol at a temperature 70° C. less than the temperature for generating bubbles in water. Asai et al used strobe techniques to observe the time between when a bubble was generated to when the bubble disappeared. Results of these observations are schematically shown in FIG. 2. Times listed indicate time elapsed after the initiation of a 10 μS heat pulse. As can be seen, generation of the bubble begins 4 μS after start of the thermal pulse. The bubble is at its maximum size at about 8 μS after start of the thermal pulse. Afterward the bubble begins to contract. Secondary bubbles are generated after the first main bubble until the last secondary bubble completely vanishes at about 20 μS after start of the heat pulse.

Asai et al describes using a heater similar to the above-described naked heater, but with a two-layer protective structure covering the alloy thin film resistor, in order to generate bubbles in water, which has nearly the same qualities as water-based ink (page 247 of Collection of Presentations from the 23rd Japan Thermal Transmission Symposium 1986-5). The results of the test are shown in FIG. 3. Power was applied so that the generation of a bubble begins at the declining edge of the thermal pulse (that is, when application of power is stopped). With this type of heater covered with the two-layer protective layer, 7 μS was required from when generation of the bubble began to when the bubble reached its maximum size. This time is fixed and independent of the duration of the thermal pulse. No data was provided for time required for the bubble to disappear. However, because generation of secondary bubbles, which is a phenomenon similar to the bubble rebound phenomenon observed during cavitation, can also be observed when the pulse width of the thermal pulse is 10 μS long, it can be assumed that bubbles begin to disappear about 25 to 30 μS after start of bubble generation.

Asai et al discloses results of generating a bubble in actual water-based ink using a heater covered with the two-layered protective structure (page 253 of the Collection of Presentations from the 25th Japan Thermal Transmission Symposium 1988-6). Microscopic bubbles appeared at a portion of the heater surface at approximately 3 $\mu$S after the start of the heat pulse. Afterward, a bubble was generated over the entire surface of the heater. Asai et al did not measure the temperature at the surface of the heater nor the heat flux to the liquid in tests of the third condition.

In contrast to this, Iida et al performed tests to accurately measure these values (see page 334 of Collection of Presentations from the 27th Japan Thermal Transmission Symposium 1990-5). Iida et al heated water using a heat pulse with duration of 5 $\mu$S or more. Initial boiling nucleation in water was observed using a strobe light with an extremely short pulse of 10 nanoseconds. The shortest boiling start time was about 3.7 $\mu$S. Theoretically predicted parameters of average speed of the temperature increase and the average speed of heat flux match with the conditions observed before and after the start of boiling. Two experiments and the results of the experiments are discussed below.

(1) In one experiment, heat was applied to 20° C. water at an average speed of temperature increase of $0.56\times10^{8}$° C./sec or greater and with an average heat flux of $1.5\times10^{8}$ W/m$^2$ or greater. The temperature at the surface of the heater at the start of boiling matched the theoretical temperature (312.5° C.) at which homogeneous nucleation is believed to occur in water at atmospheric pressure. It was determined that boiling caused by this type of rapid heating is independent of the degree of liquid subcool (that is, the difference between the bulk temperature and the temperature at the surface of the heater when boiling starts).

(2) In another experiment, heat was applied at an average speed of temperature increase of $0.70\times10^{8}$° C./sec or greater and with an average heat flux of $2.1\times10^{8}$ W/m$^2$ or greater, whereupon boiling caused by caviar-wise nucleation was observed for the first time in water. It should be noted that boiling did not occur by caviar-wise nucleation when; average speed of temperature increase or the average heat flux was less than these values. The characteristics of caviar-wise nucleation as observed in the above experiment are that first a multiplicity of small bubbles with a uniform size are generated across the entire surface of the heater at a uniform distribution. The number of bubbles rapidly increases. The bubbles couple to form a bubble film at the surface of the heater.

Contrarily, in normal homogeneous nucleation, small bubbles are generated erratically on the surface of the heater. The bubbles enlarge and couple to form the bubble film. The time period from nucleation to formation of the bubble film is much slower in normal homogeneous nucleation than in caviar-wise nucleation, which requires only 1 $\mu$S or less. Although the time period from nucleation to formation of the bubble film has not been measured in spontaneous nucleation (heterogenous nucleation), considering that the speed of temperature rise and the heat flux are comparatively small values, the speed of formation is probably fairly slow.

In summary, the speed from the start of boiling to formation of a bubble film is slowest in spontaneous nucleation, faster in homogeneous nucleation, and fastest in caviar-wise nucleation. The shortest observed example of time from heat pulse to boiling is about 3 $\mu$S. This can be estimated as the limit for conventional thermal resistors which require a thick two-layer protective covering.

The fourth condition for allowing stable ejection of ink at a high repetition speed relates to the contraction and disappearance of bubbles. There have been many attempts to control the speed at which bubbles contract and disappear in order to smooth recuperation of the meniscus after ejection and moreover to shorten the frequency and increase the speed of ejections. For example, Japanese Laid-Open Patent Publication No. SHO-55-132267 describes setting the duration of time required for the surface of the heater to cool to longer than the time required to heat the surface of the heater. Japanese Laid-Open Patent Publication Nos. SHO-55-161662, SHO-55-161663, and SHO-56-13177 describe setting the time required for the temperature at the surface of the heater to cool by half to a duration of time longer than the time required to heat the surface but shorter than four times the time required to heat the surface. However these publications do not accurately disclose data or the technical basis for these determinations. Additionally, the technical content and results of controlling the speed of bubble contraction and disappearance is questionable.

Publications by Asai and others refute these inventions (Collection of Presentations from the 22nd Japan Thermal Transmission Symposium 1985-5 and in Collection of Presentations from the 23rd Japan Thermal Transmission Symposium 1986-5). A film shaped bubble generated on the heater by application of a pulse of heat expands explosively at high pressure (several tens to hundreds of atmospheres) and at high temperature (about 300° C.). Expanding gas in the bubble is cooled by the surrounding room temperature liquid, i.e., the ink. When the bubble is at its maximum size, the interior of the bubble is almost a complete vacuum. In the next instant, the bubble begins to contract, and vanishes in about 5 $\mu$S. The heat flux from the surface of the heater to the bubble is negligible when the heater is covered by the bubble. Therefore, the speed of contraction is virtually constant and independent of the temperature at the surface of the heater.

However, when the temperature at the surface of the heater does not decrease even after the initial bubble disappears, secondary bubbles are repeatedly generated. Generation of secondary bubbles interferes with recuperation of the meniscus after ink is ejected. Inducing boiling by heating a portion of a liquid that is cooler than boiling temperature is termed subcool boiling. Thermal ink jet print heads use subcool boiling when the amount of subcooling is large. As can be seen in FIG. 3, the time required for a bubble to contract and disappear is twice as long as the time required to generate the bubble. Before a bubble is generated, a pulse of heat with long duration (10 to 50 $\mu$S) is applied to heat the water on the heater, to increase the volume of water that boils as a result, and to increase the volume of the bubble. The time for contraction of the resultant large volume bubble is about 10 $\mu$S. Whether the secondary generation of bubbles shown in FIG. 3 results from insufficient cooling of the heater temperature or from cavitation by the contraction of the bubble volume is unknown, but secondary generation of bubbles occurs in all bubble contractions in conventional technology.

In Japanese Laid-Open Patent Publication Nos. SHO-55-27281 and SHO-55-27282, Asai et al teaches that the rise in temperature of the heater and the subsequent cooling speed should be as rapid as possible. The only fixed quantity mentioned however is an extremely long pulse of 100 $\mu$S.

In order to increase the frequency or ejections and provide stable ejection at the same time, boiling must be started as quickly as possible after application of the energy pulse to the thermal resistor and also the expanded bubble must be caused to disappear as rapidly as possible. Conventional technology requires that thin film resistors include a two-layer protective coating. Such thin film resistors require at least 3 μS from after start of application of the energy pulse to when the film boiling begins. Even naked thin film thermal resistors with no protective layers, which are unreliable and impractical, require at least 4 μS to generate bubbles in ethanol. Bubbles require 30 μS or more to disappear from start of the pulse application with thin film thermal resistors with two-layer protection coverings. Bubbles generated by naked thermal resistors in ethanol require 20 μS or more to disappear. Secondary bubbles are also always generated. Secondary generation of bubbles increases the time required for bubbles to disappear, thereby interfering with efforts to increase the frequency of ejections. A large amount of energy, that is, about 17 μJ/50×50 $\mu m^2$ or more, is required to start boiling with film thermal resistors with two-layer protective coverings. Although details will be explained later in the embodiment of this application, only several μJ/50×50 μm or less of energy are required to start boiling by a protection-layerless thin film thermal resistor. Therefore, almost all of the energy applied to conventional heaters is used to heat the substrate. For this reason, the surface of the heater is hot while the bubble is vanishing. This is a major source of secondary bubble generation. Heating of the substrate is brought about by the material from which the ink channel is produced and the temperature of the ink. This is a source of unstable ink ejection.

Referring back to the second condition relating to the speed at which the thermal resistor is heated, it is technically difficult to increase the average speed of temperature increase. In fact, there is few reliable experimental reports on the average speed of temperature increase of more than $1\times10^{8\circ}$ C./sec. Japan Hardcopy '94 Presentation, 1994-6, page 141 is one example of the report. Nevertheless, it has been considered that the faster the speed at which the thermal resistor is heated, the more effective in performing ink ejection.

In order to increase the average speed of temperature increase, it is essential to employ a heater in which a protective layer is not provided on the surface of the thin film thermal resistor. Even if the protective layer is provided thereon, its thickness must be as thin as possible, that is, about 100 Å.

SUMMARY OF THE INVENTION

In view of the foregoing, it is an object of the present invention to provide an ink jet ejection recording device that can stably eject ink droplets at a high speed. The present invention also provides a method of driving the ink jet ejection recording device based on a finding that there exists an optimal range of heating speed for heating a heater.

To achieve the above and other objects, there is provided, according to one aspect of the invention, an ink ejection recording device including means for defining an ink channel, a nozzle which brings the ink channel into fluid connection with an outside atmosphere, a heater formed in the ink channel near the nozzle, and a driver circuit connected to the heater. The heater has a surface in direct contact with the ink filling the ink channel. The driver circuit applies a pulse of voltage to the heater. The pulse of voltage is determined so that the surface of the heater is rapidly heated to a temperature causing to invoke caviar-wise nucleation of the ink that is in direct contact with the surface of the heater. Expanding bubbles resulting from the caviar-wise nucleation eject an ink droplet from the nozzle. In the present invention, the heater is heated at a heating speed in a range from $1\times10^{8\circ}$ C./sec to $5\times10^{8\circ}$ C./sec.

The driver circuit rapidly heats the surface of the heater from a room temperature to a temperature substantially equal to 320° C. within a period of time ranging from 0.6 to 3 μsec.

Preferably, the heater is made from a Ta—Si—O alloy. It is also preferable that the heater have an electrically insulating film in direct contact with the ink. Preferable thickness of the electrically insulating film is approximately 100 Å. The ink used in the ink ejection recording device is water-based ink.

According to another aspect of the present invention, there is provided a method of driving an ink ejection recording device. The surface of the heater is heated at a heating speed in a range from $1\times10^{8\circ}$ C./sec to $5\times10^{8\circ}$ C./sec, causing to invoke caviar-wise nucleation of the ink that is in direct contact with the surface of a heater, so that expanding bubbles resulting from the caviar-wise nucleation eject an ink droplet from the nozzle. The surface of the heater is heated from a room temperature to a temperature substantially equal to 320° C. within a period of time ranging from 0.6 to 3 μsec. By heating the heater under these conditions, the ink in contact with the heater starts boiling with a high boiling pressure, the generated bubble has a large volume, and thus the bubble can generate pressure sufficiently large to eject the ink droplet. Accordingly, printing can be stably carried out at a high speed.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

An ink jet recording device according to a preferred embodiment of the present invention will be described while referring to the accompanying drawings.

Figure 4:
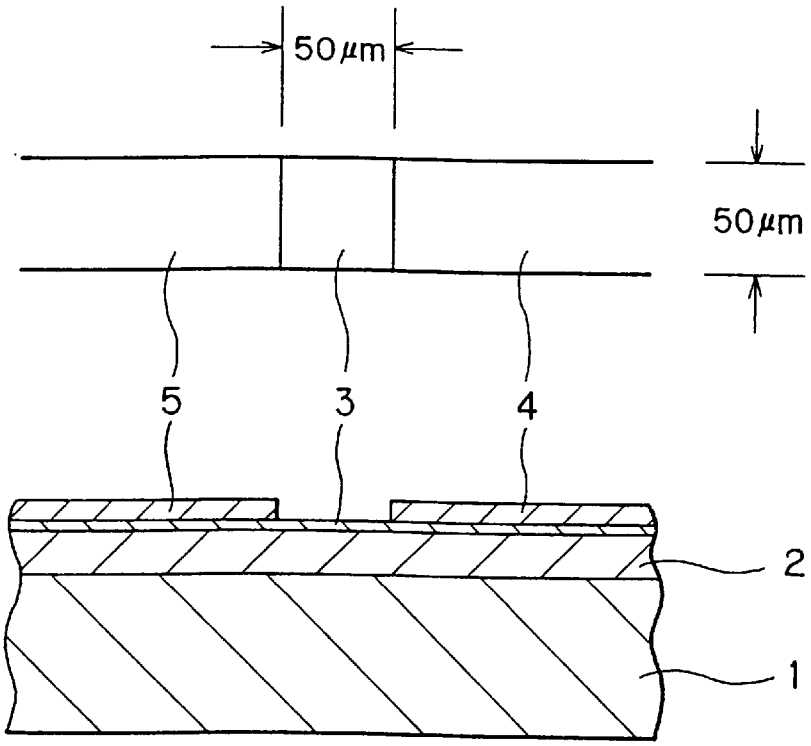
FIG. 4 shows top and cross-sectional views of a thin film thermal resistor according to the present invention.

FIG. 4 shows planar and cross-sectional views of a highly reliable protection-layerless thin film thermal resistor as described in co-pending U.S. application Ser. No. 08/172,825 filed Dec. 27, 1993, now abandoned. In this protection-layerless thin film thermal resistor, an $SiO_2$ layer of 2 $\mu$m thickness is formed on an Si substrate of 400 $\mu$m thickness, and a thin film thermal resistor 3 of 0.1 $\mu$m thickness is formed on the $SiO_2$ layer 2. Conductors 4 and 5 each being 0.1 $\mu$m in thickness are formed on the thin film thermal resistor 3. In this example, the thin film thermal resistor 3 is made from a Cr—Si—SiO alloy thin film resistor and the conductors 4 and 5 are made from nickel (Ni). However, the film thermal resistor 3 could be made from Ta—Si—SiO alloy in lieu of Cr—Si—SiO alloy, and the conductor material could be tungsten (W) or tantalum (Ta). Refer to Japanese Laid-Open Patent Publication No. SHO-58-84401 in regards to the use of Cr—Si—SiO alloy thin film resistor, and refer to Japanese Laid-Open Patent Publication No. SHO-57-61582 in regards to the use of Ta—Si—SiO alloy thin film resistor. The resistance of the resistor 2 is about 1 KΩ.

In one experiment for the present application, bubbles were generated by applying a pulse of voltage to the protection-layerless thin film thermal resistor in water. Images of the generation and disappearance of the bubbles were taken using a strobe light with a pulse time of about 1 $\mu$S. Results observed from these images will be explained below.

In another experiment for the present application, an ink channel was formed on the protection-layerless thin film thermal resistor. The ink channel was filled with ink. It will be explained later that the same results as obtained with water were obtained with ink.

For still another experiment, a multi-nozzle type ink jet recording head was formed from with a plurality of the ink channels described in the preceding paragraph. Ink droplets were continuously ejected from the head. An explanation will be provided of the recording characteristics of the head.

Figure 5:
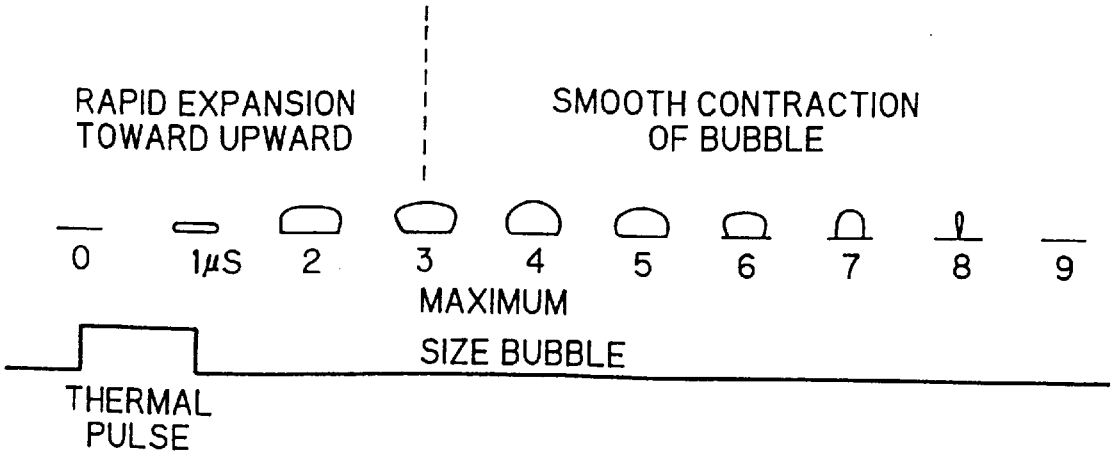
FIG. 5 schematically shows temporal changes from generation to disappearance of a bubble generated in water by pulse heating by the thermal resistor shown in FIG. 4.

Bubbles was generated in water applied to the surface of the substrate 1 by application of a 1 $\mu$S thermal pulse having an applied energy of 2.5 $\mu$J per pulse. Image were taken from the side with a VTR at about a 100 power magnification rate using a strobe light with shortest possible light pulse time of 1 $\mu$S. An example of the results are shown in FIG. 5. The times indicate the number of $\mu$S after start of the thermal pulse. Images taken when the applied energy was increased two to three times higher all appeared the same as shown in FIG. 5. Although generation of the bubble might actually have started earlier because of increased applied energy, the difference is difficult to discern with a magnification rate and pulse time used. Although no increase in the start of bubble generation could be measured under these conditions, it is clear that boiling began within 1 $\mu$S from the start of the thermal pulse.

As can be seen in FIG. 5, the generated bubble reached its maximum volume (negative pressure) and height (about 30 $\mu$m) within about 3 $\mu$S after start of the thermal pulse. About 5 $\mu$S later, the bubble vanishes with no generation of secondary bubbles. That is, by the time the bubble vanished, the surface of the thermal resistor had cooled to near room temperature. Energy produced when a bubble of this volume vanishes is insufficient to cause cavitation. Excessive heating of the ink is avoided and heat efficiency is improved. The temperature of the ink is stabilized, which in turns stabilizes the viscosity of the ink, thereby improving stability of ink ejection conditions. Coagulation of ink to the heater surface is prevented.

The average speed of temperature increase produced by the thin film thermal resistor according to the present invention is, for example, $3\times10^{8}$° C./sec (350° C.–25° C./1 $\mu$S, assuming room temperature is 25° C.). This exceeds the above-described maximum value of $0.7\times10^{8}$° C./sec for average speed of temperature increase attainable using conventional technology. Although the power applied to the heater is large, i.e., $1\times10^{9}$ W/m$^2$, considering that 70 to 80% of this goes to the substrate as heat flux, this matches the conditions for caviar-wise nucleation observed by Iida et al (page 335 of the Collection of Presentations from the 27th Japan Thermal Transmission Symposium 1990-5). Furthermore, a bubble film about 5 to 10 $\mu$m high is formed on the surface of the thermal resistor about 1 $\mu$S after pulse heating is started. The speed at which the bubble grows is faster than the growth speed under the conditions for caviar-wise nucleation observed by Iida et al. That is, from these results, the bubble shown in FIG. 5 is generated by caviar-wise nucleation induced boiling.

The average speed at which the bubbles expanded (i.e., (dv/dt)/v) can be determined from FIG. 5 as $4\times10^{5}$/S, a much faster average speed than disclosed in Japanese Laid-Open Patent Publication No. SHO-55-161665. This value remained constant, even when the duration of the applied pulse was increased to 2 or even 4 $\mu$S, which is also different from the data disclosed in Japanese Laid-Open Patent Publication No. SHO-55-161665. The difference in speeds of bubble expansion probably appears because caviar-wise nucleation produces a much faster average speed of temperature increase than does spontaneous nucleation.

All factors must be taken into account when setting the duration of the thermal pulse. For example, heat efficiency is greatly improved when the thermal pulse is shorter than 1 $\mu$S. However, the time at which caviar-wise nucleation starts increases to at best only 0.5 $\mu$S after start of the heat pulse. These benefits are small considering the time from application of the pulse to when the bubble disappears (about 8 $\mu$S in FIG. 2) and the time required for the meniscus to recover after ink is ejected (several 10s or 100s $\mu$S). Additionally, the power (applied voltage) must be increased to compensate for the short duration of the thermal pulse, which can be disadvantageous. A thermal pulse with duration of more than 1 $\mu$S risks generation of secondary bubbles and a drop in heat efficiency. The maximum duration of the thermal pulse is probably 3 $\mu$S. This would translated into boiling start time of 2 $\mu$S after start of the pulse.

As can be seen in FIG. 5, no secondary bubbles are generated in bubble generation according to the present invention. Therefore, the time required for a bubble to totally disappear is shortened. Ink ejection is stabilized and the ejection cycle can be reduced so that high speed ejection is possible.

Figure 1:
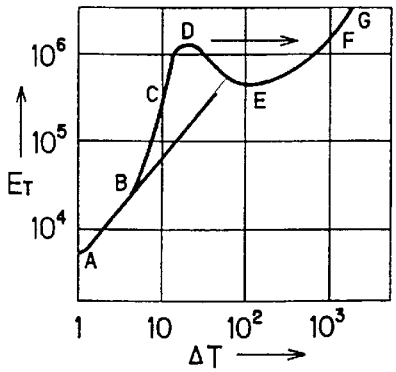
FIG. 1 is a graphical representation of the boiling characteristic curve of water.
Figure 3:
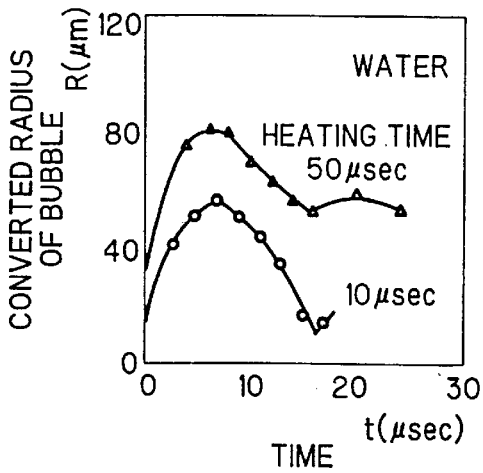
FIG. 3 shows a graphical representation of temporal changes in the radius of bubbles generated using a conventional thermal resistor.
Figure 2:
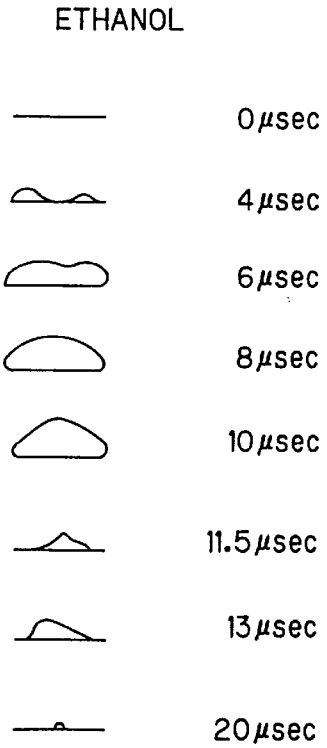
FIG. 2 schematically shows temporal changes from generation to disappearance of a bubble generated in ethanol using a conventional thermal resistor.

In the conventional bubble generation shown in FIG. 2, wherein a bubble was generated in ethanol, 12 $\mu$S elapsed between when the bubble was at its maximum volume (that is, at the 8 $\mu$S point) to when the bubble disappeared entirely. In water, as shown in FIG. 3, 20 $\mu$S or more was necessary. Generation of secondary bubbles clearly causes the need for such long disappearance times (that is, time required for a bubble to go from its maximum size to complete disappearance). Asai et al (1986) explains this long disappearance time as being caused by bubble rebound phenomenon, which is very similar to cavitation damage.

The present inventors confirmed generation of secondary bubbles using a heater from a Hewlett Packard ink jet printer (Model No. JP51626A). The disappearance time was about 10 μS. However, the present inventors have determined that this generation of secondary bubbles is not cavitation-like rebound as Asai et al stresses, but is caused simply by the heater temperature not cooling sufficiently during the disappearance time. If secondary bubbles are generated by a hot heater surface, removing this cause should prevent generation of secondary bubbles and reduce disappearance time.

Figure 6:
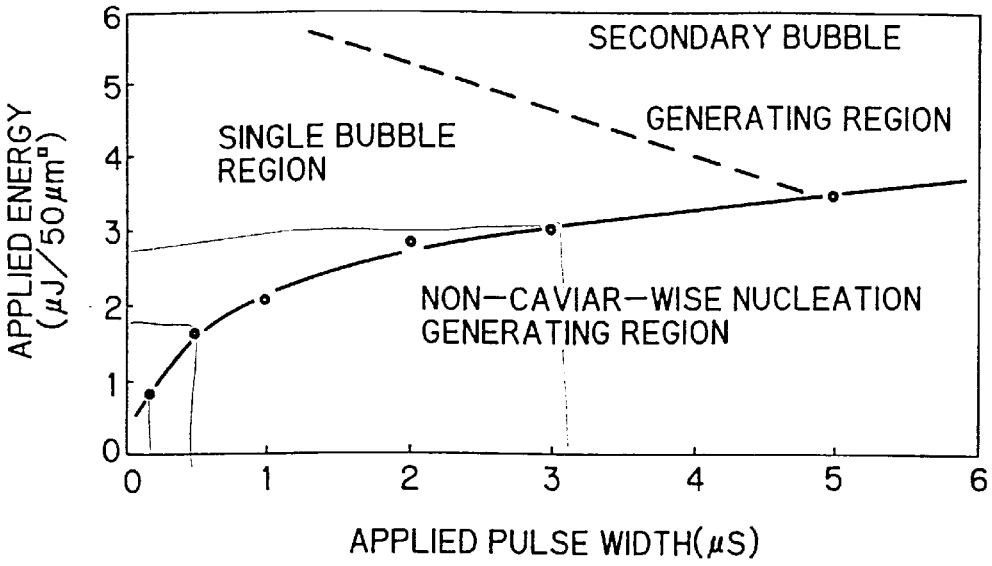
FIG. 6 is a graphical representation showing a relationship between energy level and pulse duration applied to the thermal resistor shown in FIG. 4 to induction of caviar-wise nucleation (solid line) and single bubble generation region (dash line)

The present inventors performed tests to confirm this. A protection-layerless thin film thermal resistor shown in FIG. 4 was produced. The thin film thermal resistor was energized in water at various energy levels and for various durations of time. The generation and disappearance of the resultant bubbles were observed using a strobe light. The results of the test are shown in FIG. 6. The solid line indicates the limit of the range at which swing formation occurred. The broken line indicates the limit of the range at which generation of secondary bubbles was observed. The region labeled "single bubble region" in FIG. 6 is where a single bubble could be stably and repeatedly generated. The disappearance time was constantly about 5 μS throughout the single bubble region. Stable repetitive generation of bubbles without generating secondary bubbles was possible in a sufficiently broad range of drive conditions.

It is clear that secondary bubbles are generated because the heater does not cool quickly enough and remains hot enough to generate bubbles. Therefore the disappearance time required for a bubble to disappear without generation of secondary bubbles depends on the characteristics of the liquid in which the bubble is generated, not on the drive conditions of the thermal resistor. In water, the disappearance time was constant at about 5 μS. These results were basically repeated in tests using water-based ink.

In the present invention, the ripple effect greatly shortens the time required for heating and greatly decreases the amount of ink that burns onto the surface of the heater. This increases the life of the head to the point where head replacement is unnecessary.

In the present invention, the duration of the thermal pulse is set to 3 μS or less so that the generation of secondary bubbles is effectively prevented. Additionally, the disappearance time is about 8 μS, which is a great improvement over conventional technology. Caviar-wise nucleation allows a bubble to disappear in 10 to 11 μS or less after start of the voltage pulse, which is approximately ½ to ⅓ the time required with conventional technology. As is clearly shown in FIG. 6, the energy required to stably generate single bubbles is 4 μJ/50×50 $\mu m^2$ or less, which is ⅕ to 1/10 the amount of energy required for conventional technology.

A single nozzle head was produced to observe the above described effects. To produce the observation head, a channel with width of 60 μm and height of 40 μm was provided to the substrate 1 shown in FIG. 4. The single nozzle with a diameter of about 45 μm was provided perpendicular to the channel and to the surface of the thermal resistor at a position centered on the thermal resistor. Images were taken of generation and disappearance of bubbles from a thin side wall using a strobe light. Results were as predicted. The shape of the bubble was somewhat different because the channel formed boundaries for the liquid. However, this channel will not greatly effect generation and disappearance of bubbles.

Tests and results of the tests regarding generation and disappearance of bubbles when a protection-layerless thin film thermal resistor is pulse heated are described in detail above. The time required to generate a bubble and time required for the bubble to disappear are greatly reduced. This contributes greatly to increasing the repetition frequency of stable ejection of ink. The amount of energy needed to eject ink is reduced by an order of magnitude as mentioned above. This shows that almost no energy is consumed in heating the channel material or ink. The temperature of ink in the head need not be maintained at any particular level. Also, because the amount of ink that burns and becomes stuck to the surface of the heater is greatly reduced, the life and reliability of the head are greatly increased.

To summarize, it is desirable that the total amount of electric power applied to the thermal resistor, the thermal flux applied to ink, and the speed of temperature increase in ink (STI) be set as indicated in the table below in relation to the duration of a pulse of voltage (DPV) applied to the thermal resistor which is set to 3 μs, 2 μs and 1 μs.

| DPV (ps) | Total Power ($W/m^2$) | Thermal Flux ($W/m^2$) | STI (° C./s) |
|---|---|---|---|
| 3 | $4 \times 10^8$ | $1 \times 10^8$ | $1.1 \times 10^8$ |
| 2 | $5.6 \times 10^8$ | $1.4 \times 10^8$ | $1.6 \times 10^8$ |
| 1 | $8 \times 10^8$ | $2 \times 10^8$ | $3 \times 10^8$ |

It should be noted that the above values can be obtained from the graph shown in FIG. 6. The total electric power applied to the heater can be computed by dividing the applied energy by the duration of pulse voltage. The heat flux applied to ink is computed on the assumption that the heat flux applied to the ink is one quarter (¼) of the total amount of power applied to the heater based on the previous disclosure that 70 to 80% of power applied to the heater goes to the substrate as heat flux. The speed of temperature increase in ink is obtained as per a unit of time, second.

From the above table, various parameters to produce bubbles by subcool boiling caused by caviar-wise nucleation are set as follows according to the present invention. The pulse of voltage applied to the heater has a duration equal to or less than 3 μsecond. Speed of temperature increase in the ink is set equal to or greater than $1.1 \times 10^{8\circ}$ C./sec, and heat flux applied to the ink by the heater is set equal to or greater than $1 \times 10^8 W/m^2$.

Figure 7:
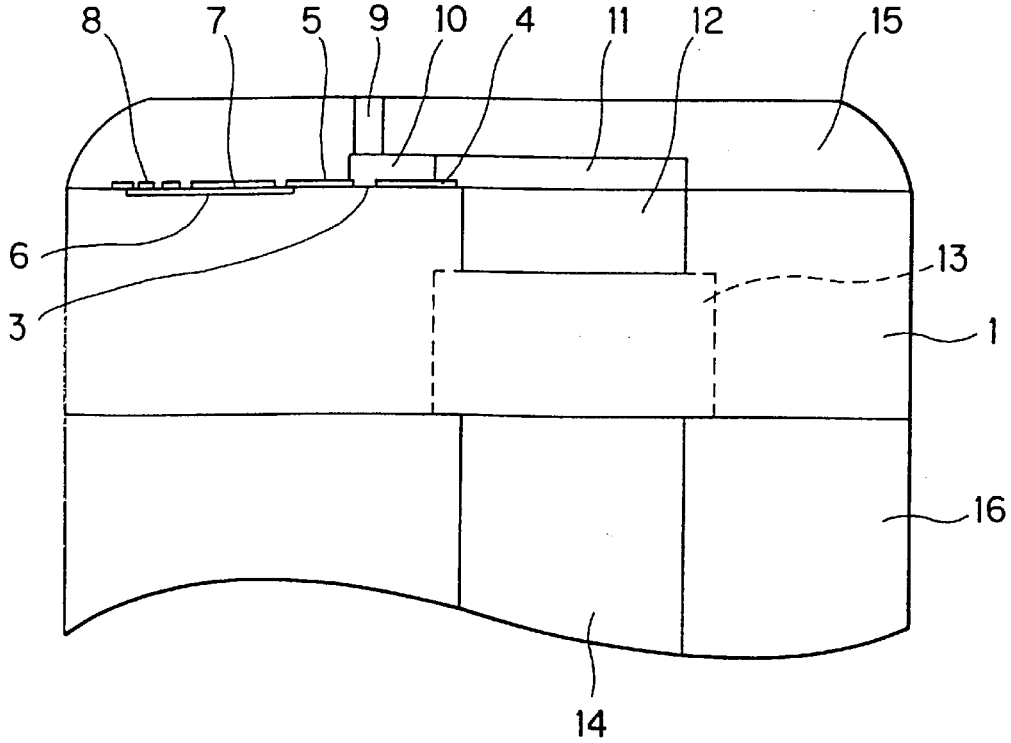
FIG. 7 is a cross-sectional view showing a print head according to the present invention.

Next, the multi-nozzle type ink jet recording head shown in FIG. 7 was produced using the thin film thermal resistor shown in FIG. 4. First, a Cr—Si—SiO— alloy thin film thermal resistor 3 and an integrated circuit (IC) 6 for driving the thermal resister 3 were formed on the surface of a silicon substrate 1. For driving the head, a nickel common wire conductor 4, individual nickel wire conductors 5, drive power wire conductors 7, and signal wire conductors 8 were formed to the substrate 1. An ink channel plate 15 was formed with ink nozzles 9, individual ink channels 10, and a common ink channel 11. The ink channel plate 15 was mounted to the silicon substrate 1 to form a monolithic large scale integrated (LSI) head. The monolithic LSI head was die bonded to a frame 16. Ink was supplied to the ink channels 11 from the ink channel 14 in the frame 16 and through connection aperture 13 and the common ink channel 12 in the silicon substrate 1. Ink was ejected from one ink nozzle 9 after another. In this example, the Cr—Si—SiO alloy thin film thermal resistor 3 was formed to 45 μm by 45 μm, the ink channel nozzle was formed to a diameter of 45

μm, and the individual ink channels were formed with a width of about 50 μm, a height of 35 μm, and a length of 150 μm.

A plurality of ink nozzles 9 were provided aligned at a pitch of about 7 μm (360 dpi) in the direction perpendicular to the surface of the sheet one which FIG. 7 is drawn. Heads of various sizes can be produced as described in Japanese Laid-Open Patent Publication No. HEI-05-90123. For example, a small serial scanning type head with total number of, for example, 64 nozzles can be produced or a line head for A4 size paper or larger with two rows of 1,512 nozzles, for a total of 3,024 nozzles, can be produced.

Tests were performed to determine the recording characteristics of the head. The maximum frequency at which ejection could be stably performed was determined to be 8 KHz. As a comparison, a head produced by Hewlett-Packard with the same configuration as shown in FIG. 7, but wherein the thin film thermal resistors are covered with a two-layer protective covering, has a maximum frequency of about 6 KHz. The head according to the present invention required between 2.0 to 2.5 μJ/droplet for ejection, which can be over an order of magnitude less than the 17 to 30 μJ/droplet required for ejection by conventional heads. The head according to the present invention showed stable ejection even after 100 million or more ejections. The same results were obtained in a print head according to the present invention wherein the direction of ejection is parallel with the surface of the heater.

According to the present invention, by driving a protection-layerless heater with only a short pulse of voltage, ink can be heated at an extremely fast average speed of temperature increase. Therefore, the time between when the pulse is applied and when the bubble disappears is 11 μS or less. This is about ⅓ the time for conventional technology. The print speed (ejection frequency) of the thermal ink jet recording head according to the present invention is 30% or greater than conventional heads. About one order of magnitude less power is consumed.

Figure 8A:
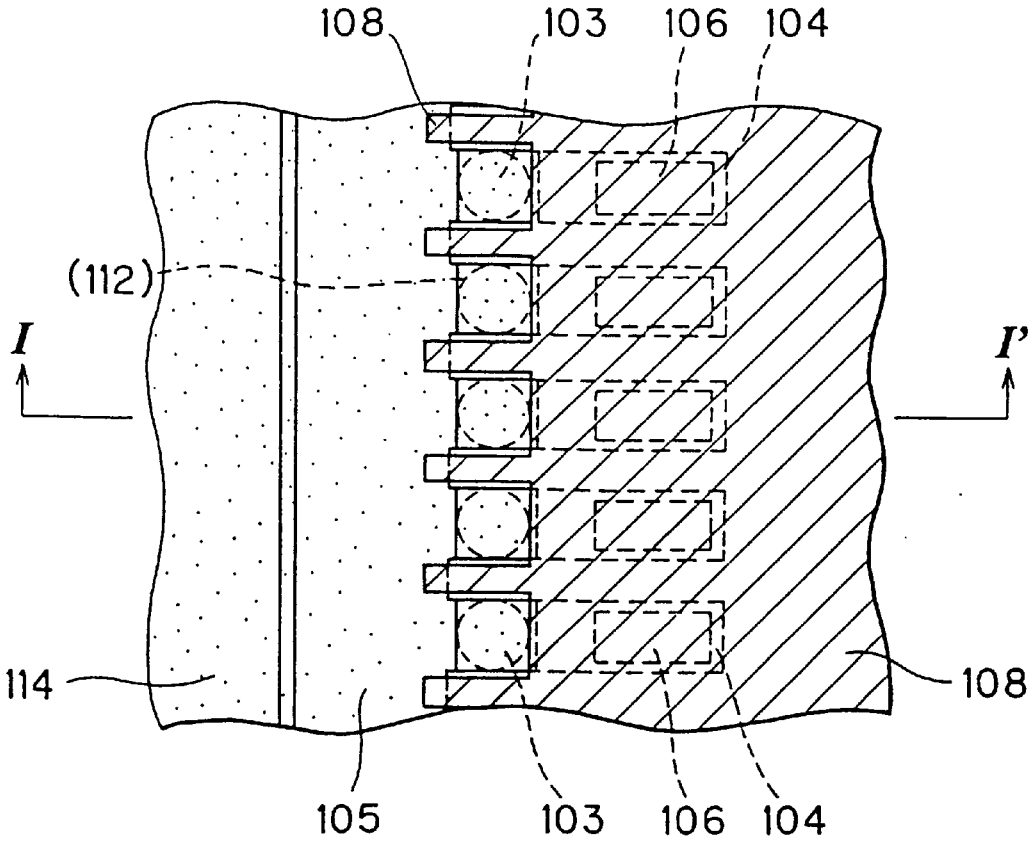
FIGS. 8(*a*) and 8(*b*) show cross-sectional views of the preferred embodiment ink jet printing device wherein FIG. 8(*a*) is a horizontal cross-sectional view cut along a line A—A' indicated in FIG. 8(*b*), and FIG. 8(*b*) is a vertical cross-sectional view cut along a line B—B' indicated in FIG. 8(*a*)
Figure 8B:
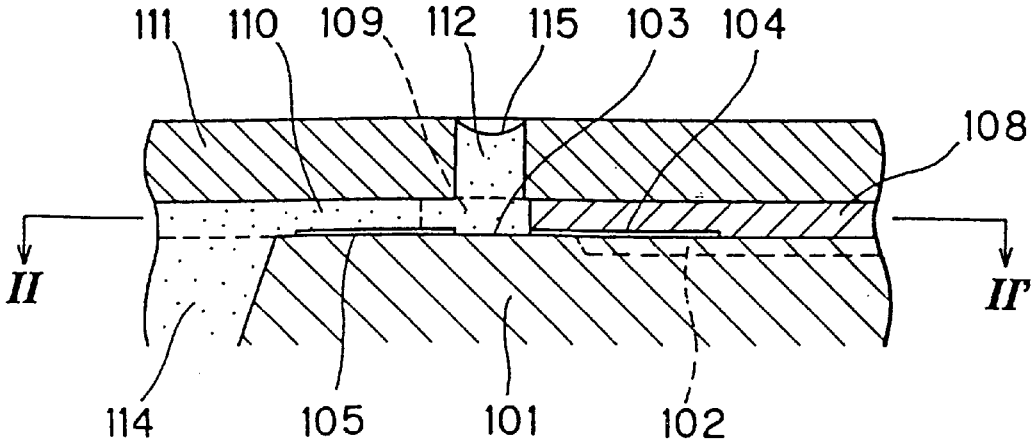

A second embodiment of the present invention will be described with reference to FIGS. 8(*a*), 8(*b*), 9 and 10.

First, an ink jet ejection device according to the present invention is described with reference to FIGS. 8(*a*) and 8(*b*). FIGS. 8(*a*) and 8(*b*) show a heating portion of the ink jet ejection device. FIG. 8(*a*) is a horizontal cross-sectional view cut along a line A—A' in FIG. 8(*b*), and FIG. 8(*b*) is a vertical cross-sectional view cut along a line B—B' in FIG. 8(*a*). In this heating device, a $SiO_2$ heat shielding layer (not shown) of 1 to 2 μm thickness is formed on a silicon substrate 101. On this silicon substrate 101, a thermal resister assembly is formed. The thermal resistor assembly includes thin film thermal resistors (hereinafter referred to as a "heater") 103 of approximately 0.1 μm, individual nickel thin film conductors 104 of approximately 1 μm, and a common nickel thin film conductor 105 of approximately 1 μm. The heater 103 is made from a Ta—Si—O alloy. The heaters 103 and the thin film conductors 104 and 105 are formed by sputtering or photo-etching.

A driver circuit 102 is formed on the silicon substrate 101. This driver circuit 102 is connected to the individual nickel thin film conductors 104 through through-holes 106. Signal lines and a power source line are connected to the driver circuit 102 which selectively applies pulses of voltage to the heaters 103.

Before forming partition walls 108 on the heaters 103, a thermal oxidizing treatment is carried out to form a 100 Å thick electrically insulating film on the surface of the heaters 103. To this end, voltage pulses, each having a duration of 100 μs, produced at every 200 μs period by the application of 1.5 watt power are applied to the heaters in air. By doing so, the heaters 103 do not suffer from electrochemical corrosion which may otherwise be caused by the contact with an electrolytic ink. The electrically insulating film formed on the surface of the heaters 103 also protects the heaters 103 against damage from cavitation. With the use of such heaters, the ink jet print head can withstand repetitive ink ejections of more than several millions.

Ink channels including the individual ink channels 109 and the common ink channel 10 are formed by the partition walls 108 and an orifice plate 111 formed with a plurality of orifices 112 from which ink droplets are ejected. For the nozzles of the head aligned in 400 dots per inch, i.e., 62.5 μm pitch, the size of the heater 103 is 45 μm×45 μm, the diameter of the nozzle 112 positioned immediately above the heater 103 is 45 μm, the height of the partition wall 108 is 15 μm, the thickness of the orifice plate 111 is 50 μm, and the resistance value of the heater 103 is approximately 100 Ω.

Using water-based ink having a viscosity of approximately 2.5 cμs at a temperature of 20° C. in the above-described head and applying pulses of voltage having a duration of τ to the heater 103, images of ink droplets were taken using a strobe light to measure the ink droplet ejection speed. The applied power to the heater 103 is determined so that the ink surface (meniscus 115) in the ink nozzle starts moving when the heater 103 is energized with pulses of voltage having a duration of 0.8 τ. Specifically, energy is applied to the heater 103 so that boiling of the ink starts with 80% of the energy applied. The applied energy is approximately 103 μJ when τ=1 μsec. This is as small as one fifth (⅕) to one tenth (1/10) relative to the energy required for the conventional heaters.

Figure 9:
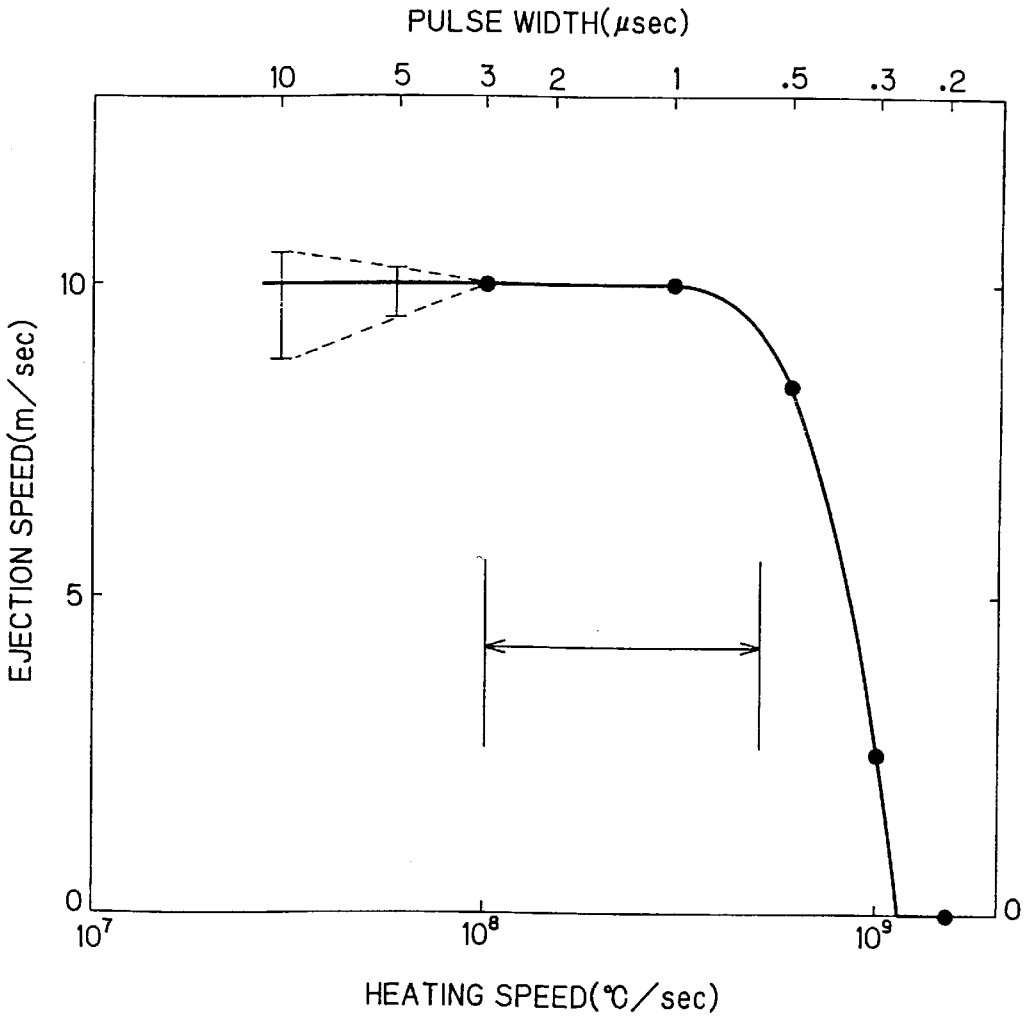
FIG. 9 is the graphical representation showing a relationship between heater heating speed and ink ejection speed measured using an ink jet printing device as shown in FIGS. 8(*a*) and 8(*b*)

FIG. 9 shows a relationship between the heating speed or applied pulse width x and an ejection speed of ink droplet ejected under the condition described above. Because the bubble generating temperature of the water-based ink is approximately 300° C., the heating speed for the heater is assumed to be approximately 300° C./τ. The results of the experiments show that the ink ejection speed varies when the heating speed is below $1\times10^{8}$° C./sec, the ink ejection speed abruptly decreases when the heating speed is above $5\times10^{8}$° C./sec, and ink ejection is disabled when the heating speed has reached $1.2\times10^{9}$° C./sec although vibrations of the meniscus is observed.

It is considered that the variation of the ink ejection speed results from the variation in the bubble generation position on the heater as reported at page 253 of the 25th Japan Thermal Transmission Symposium 1988-5. The heating speed in the report of the above-described publication is assumed to be 6 to $7\times10^{7}$° C./sec because of the use of a heater provided with a protective layer of a thick double layered structure. The results of the experiments generally agree with the analysis in the above-described publication.

The abrupt decrease of the ink ejection speed when the heating speed is above $5\times10^{8}$° C./sec, and ink ejection incapability when the heating speed has reached $1.2\times10^{9}$° C./sec are the phenomena that the present inventors have found. This phenomena do not agree with the description in Japanese Laid-Open Patent Publication No. 3-266646. The reason for this inconsistency is due to the fact that the Japanese Laid-Open Patent Publication describes the analysis based on the experiments performed under a condition where the heating speed is below $0.93\times10^{8}$° C./sec. In summary, an optimum range of heating speed allowing to achieve stable and high speed ink ejection is $1\times10^8$ through $5\times10^{8\circ}$ C./sec. When printing is carried out under this condition, the ejection of ink is uniformly performed and a high printing quality is obtained.

Figure 10:
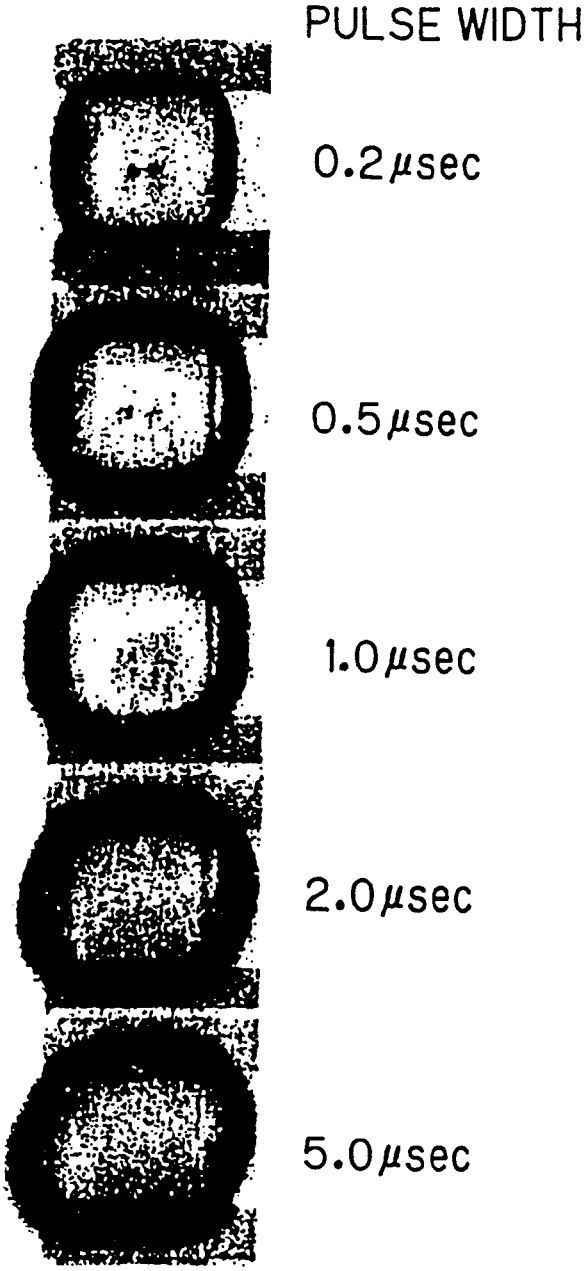
FIG. 10 shows strobe observation results showing a relationship between maximum size of bubbles and applied pulse width wherein the bubbles are observed when ink is open-pool boiled using a heater substrate shown in FIGS. 8(*a*) and 8(*b*).

Existence of the upper limit of the heating speed is proven by the following experimental results. The pulses of voltage are applied to the heaters under the same condition described previously while filling water-based ink (semi-transparent yellow ink) to a depth of approximately 300 $\mu$m above the heater substrate, and the bubble generation is observed from the position immediately above the heater using strobe light. FIG. 10 is a photograph showing the growing bubbles. Apparently, the size of the bubble is small when $\tau$=0.2 $\mu$sec ($1.5\times10^{9\circ}$ C./sec). The size of the bubble did not change even if the applied power is increased. This is because an amount of water-based ink to be heated by the heater, that is, the thickness of the ink portion to be heated by the heater decreases when the heating speed is too high. Once the ink starts boiling, the surface of the heater and the water are thermally separated, with the result that an amount of vaporizing ink is reduced and thus the maximum volume of the expanding bubble remains small. The foregoing is the reasons for the existence of the upper limit in the optimum heating speed.

The reasons why the volume of the bubble when $\tau$=0.5 $\mu$sec is large is that the shape of the bubble varies depending on the bubble generating positions and the bubbles thus generated are observed as a whole. For the same reasons, the ink ejection speed varies in this condition.

The generation of the bubbles are independent of the shape and the size of the heater. The optimum heating speed as described above is equally applicable to a side shooter type thermal ink jet ejection device in which ink droplets are ejected in a direction in parallel to the surface of the heater.

As described above, the present invention has been made in view of the finding that there is an optimum range of heating speed. By operating the ink jet ejection device under the optimum conditions, stable and high speed ink ejection can be achieved and hence a high quality printing can be obtained.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. An ink ejection recording device comprising:

means for defining an ink channel, ink being filled in said ink channel;

a nozzle which brings said ink channel into fluid connection with an outside atmosphere;

a heater of a Ta—Si—O alloy formed in said ink channel near said nozzle, said heater having a surface in direct contact with the ink and heating the surface from room temperature to a temperature equal to 320° C. within a period of time between 0.6 and 3 $\mu$sec; and a driver circuit connects to said heater, for applying a pulse of voltage to said heater, the pulse of voltage being determined so that the surface of said heater is rapidly heated to a temperature causing to invoke caviar-wise nucleation of the ink that is in direct contact with the surface of said heater, expanding bubbles resulting from the caviar-wise nucleation ejecting an ink droplet from said nozzle, wherein said heater is heated at a heating speed in a range from $1\times10^8$ °C./sec to $5\times10^8$ °C./sec.

2. The ink ejection recording device according to claim 1, wherein said heater has an electrically insulating film in direct contact with the ink.

3. The ink ejection recording device according to claim 2, wherein said electrically insulating film has a thickness of 100 Å.

4. The ink ejection recording device according to claim 1, wherein the ink is water-based ink.

5. The method according to claim 1, wherein said heater heats water-based ink filled in said ink channel.

6. An ink injection recording device as claimed in claim 1, wherein said surface is smaller than 50 $\mu$m×50 $\mu$m.

7. A method of driving an ink jet recording device including:

means for defining an ink channel, ink being filled in said ink channel;

a nozzle which brings said ink channel into fluid connection with an outside atmospher;

a heater of a Ta—Si—O alloy formed in said ink channel near said nozzle, said heater having a surface in direct contact with the ink; and a driver circuit connected to said heater for applying a pulse of voltage to said heater, the method comprising the step of:

heating the surface of said heater at a heating speed in a range from $1\times10^8$ °C./sec to $5\times10^{8\circ}$ C./sec, such that the surface is heated from room temperature to a temperature equal to 320° C. within a period of time between 0.6 and 3 $\mu$sec, heating said surface causing caviar-wise nucleation of the ink that is in direct contact with the heated surface, expanding bubbles resulting from the caviar-wise nucleation ejecting an ink droplet from said nozzle.

8. A method according to claim 7, wherein said heater has an electrically insulating film in direct contact with the ink.

9. The method according to claim 8, wherein said electrically insulating film has a thickness of 100 Å.

10. A method of driving an ink ejection recording device as recited in claim 7, wherein said surface is smaller than 50 $\mu$m×50 $\mu$m.

* * * * *